US006820677B2

(12) United States Patent
Grinberg et al.

(10) Patent No.: US 6,820,677 B2
(45) Date of Patent: Nov. 23, 2004

(54) METHOD OF MAKING A SPRAY FORMED ARTICLE

(75) Inventors: Grigoriy Grinberg, Sylvania, OH (US); David Robert Collins, Saline, MI (US); Matthew M. Shade, Plymouth, MI (US)

(73) Assignee: Ford Motor Company, Dearborn, MI (US)

( * ) Notice: Subject to any disclaimer, the term of this patent is extended or adjusted under 35 U.S.C. 154(b) by 62 days.

(21) Appl. No.: 10/224,048

(22) Filed: Aug. 20, 2002

(65) Prior Publication Data

US 2004/0035543 A1 Feb. 26, 2004

(51) Int. Cl.[7] ..... B22C 1/00; B22D 23/00; B22D 29/00

(52) U.S. Cl. ..... 164/46; 164/131; 164/529

(58) Field of Search ..... 164/529, 46, 131, 164/132, 528

(56) References Cited

U.S. PATENT DOCUMENTS 4,438,804 A * 3/1984 Aiga et al. ..... 164/522
4,723,589 A * 2/1988 Iyer et al. ..... 164/46
5,155,321 A 10/1992 Grube et al.
5,262,100 A * 11/1993 Moore et al. ..... 264/489
5,337,631 A * 8/1994 Singer et al. ..... 76/107.1
5,352,405 A 10/1994 Beaman et al.
5,430,666 A 7/1995 DeAngelis et al.
5,658,506 A 8/1997 White et al.
5,733,497 A 3/1998 McAlea et al.
5,817,206 A 10/1998 McAlea et al.
5,947,179 A * 9/1999 Kinane et al. ..... 164/45
5,967,218 A * 10/1999 Pergande et al. ..... 164/46
6,179,039 B1 * 1/2001 Grinberg et al. ..... 164/4.1
6,276,431 B1 8/2001 Grinberg et al.

* cited by examiner

*Primary Examiner*—Kuang Y. Lin
(74) *Attorney, Agent, or Firm*—Brooks Kushman P.C.; Damian Porcari

(57) ABSTRACT

A method of making a spray formed article includes the steps of providing a sand pattern and spraying metal material toward the sand pattern to form the desired article. The sand pattern is made from a sand molding composition comprising refractory materials and binder. The refractory material comprises at least about 15 weight percent alumina, based on the total weight of the refractory material.

18 Claims, 2 Drawing Sheets

Fig. 1b
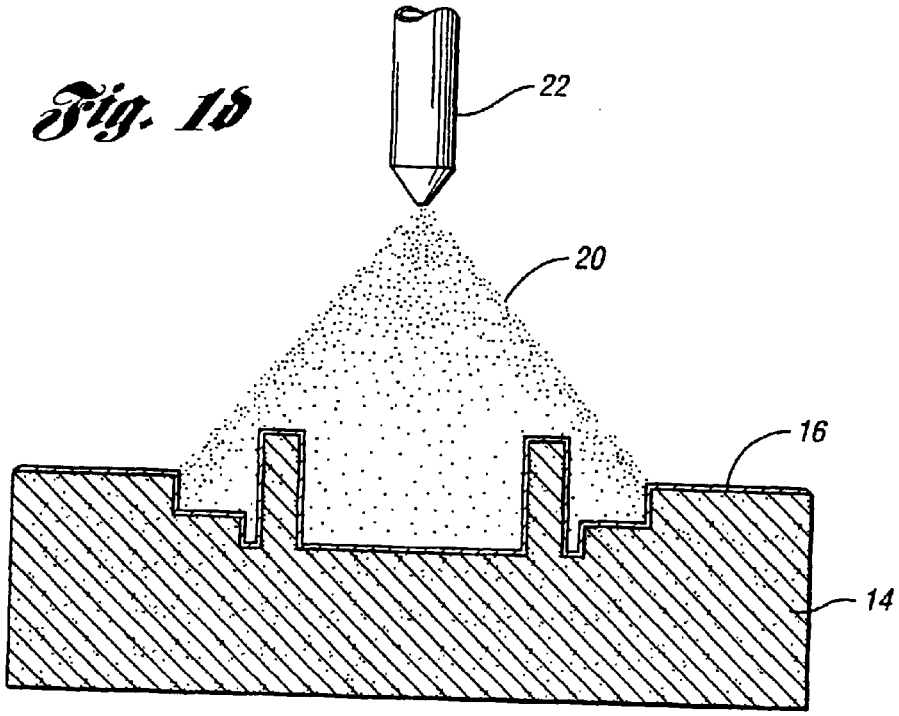
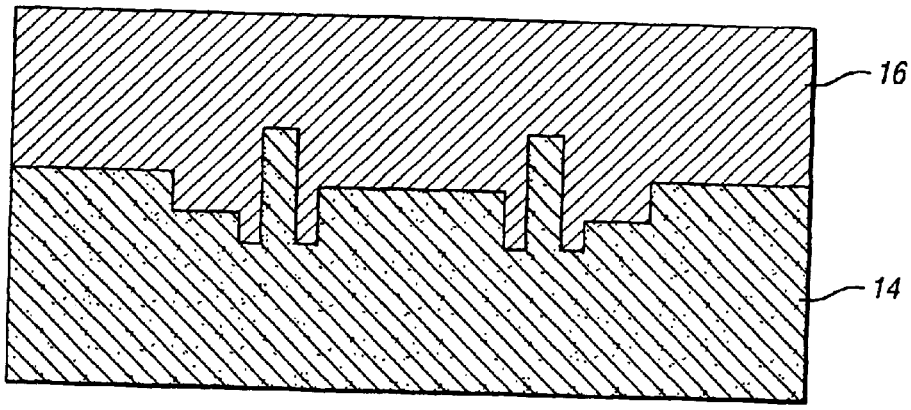
Fig. 1e
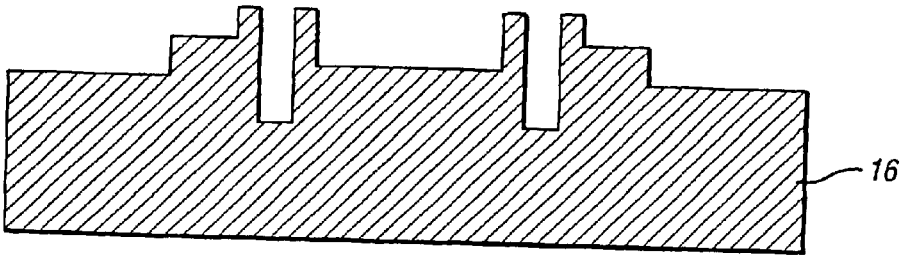
Fig. 1f

METHOD OF MAKING A SPRAY FORMED ARTICLE

BACKGROUND OF THE INVENTION

1. Field of the Invention

In at least one aspect, the present invention relates generally to spray formed articles and, more specifically, to a method of making a spray formed article.

2. Background Art

It is known to make spray formed articles such as a spray formed tool. For instance, in spray forming a tool, metal is sprayed onto a ceramic pattern to form the desired tool. The ceramic pattern is essentially the reverse of the desired tool to be produced. Typically, a ceramic slurry is poured onto a master model and solidified to form the ceramic pattern. When solidification is complete, the resulting ceramic pattern is put through a series of heat cycles and becomes the receptor onto which metal is sprayed to form a deposit in the shape of the desired tool.

One typical spray forming process comprises wire-arc thermal spraying. In a common type of wire-arc spraying, electric current is carried by two electrically conductive, consumable wires with an electric arc forming between the wire tips. A high-velocity gas jet blowing from behind the consumable wire tips strips away the molten metal, which continuously forms as the wires are melted by the electric arc. The high-velocity gas jet breaks up or atomizes the molten metal into finer particles to create a distribution of molten metal droplets. The atomizing gas then accelerates the droplets away from the wire tips towards the ceramic pattern where the molten metal droplets impact the ceramic pattern to incrementally form a deposit in the shape of the desired article.

The desired article is then removed from the ceramic pattern. The removal is typically accomplished by cutting off the perimeter of the metal deposit with a high pressure waterjet, chiseling off the majority of the ceramic pattern and then using a glass bead blaster to remove the residual ceramic from the surface of the desired article. In the case of a tool, the completed tool is then mounted and used to produce parts in conventional stamping, die casting, molding, or other tool-usable processes.

Although the above process for making a spray formed article has worked well, it suffers from the disadvantage that it can take a considerable amount of time to remove the ceramic pattern from the spray-formed article. Another disadvantage of the above process is that the ceramic pattern can be relatively time consuming and costly to make. Therefore, there is a need in the art to produce patterns for a spray formed article that can be made less time consuming and costly than other prior art processes.

SUMMARY OF THE INVENTION

Accordingly, in at least one embodiment, the present invention comprises a method of making a spray formed article. The method includes the steps of providing a sand pattern that has an inverse of at least a portion of the surface of the spray formed article. The sand pattern is formed from a sand molding composition that comprises refractory material and binder. The refractory material comprises at least about 15 weight of percent alumina, based on the total weight of the sand molding composition. The method also includes the step of spraying metallic material toward the sand pattern to form the spray formed article.

In another embodiment of the present invention, the present invention comprises the step of providing a sand pattern that has an inverse of at least a portion of the surface of a desired spray formed article, wherein the spray forming pattern comprises the cured product of a sand molding composition comprising refractory material and an inorganic, water-soluble binder. In this embodiment, the present invention also comprises the steps of spraying metallic material against the sand pattern to form a desired spray formed article on the sand pattern and separating the sand pattern from the desired article by exposing the sand pattern to water.

In another embodiment of the present invention, the present invention comprises the step of providing a sand pattern that has an inverse of at least a portion of the surface of a desired spray formed article, wherein the spray forming pattern comprises the cured product of a sand molding composition comprising refractory material present in the sand molding compound in an amount of about 75 to 98 weight percent, based on the total weight of the sand molding composition, an inorganic, water-soluble binder present in the sand molding composition in an amount of about 2 to 25 weight percent, based on the total weight of the sand molding composition, and catalyst present in the sand molding composition in an amount of about 0.2 to 2.5 weight percent, based on the total weight of the sand molding composition. In this embodiment, the refractory material has an average particle size of about 25–400 microns and comprises silica sand and at least about 15 weight percent alumina, based on the total weight of the refractory material. In this embodiment, the present invention also comprises the steps of spraying metallic material against the sand pattern to form a desired spray formed article on the sand pattern and separating the sand pattern from the desired article by exposing the sand pattern to water.

One advantage that can be found in at least one embodiment of the present invention is that a method is provided for making a spray formed article that can be made less time consuming and costly than other prior art processes.

Another advantage that can be found in at least one embodiment of the present invention is that a method is provided for making spray formed articles that can have better metal adhesion to the spray forming pattern than other prior art processes.

Another advantage that can be found in at least one embodiment of the present invention is that a method is provided for making spray formed articles that can be removed from the spray forming pattern more easily than other prior art processes.

Other features and advantages of the present invention will be readily apparent from the following detailed description taken in conjunction with the accompanying drawings.

DETAILED DESCRIPTION OF THE PREFERRED EMBODIMENT(S)

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1A:
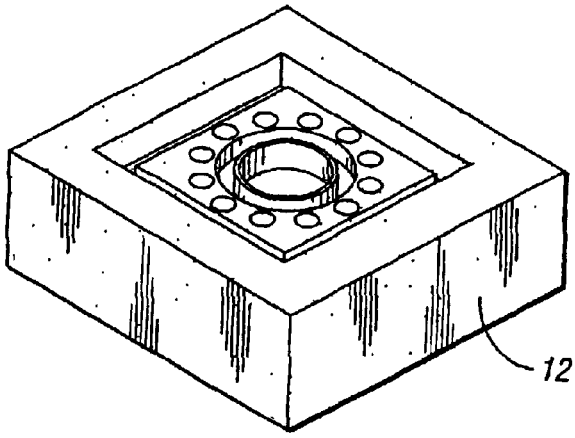
FIGS. 1*a,* 1*b,* 1*c,* 1*d,* 1*e* and 1*f* are a schematic flow diagram of a method of making a spray formed article according to the present invention.
Figure 1B:
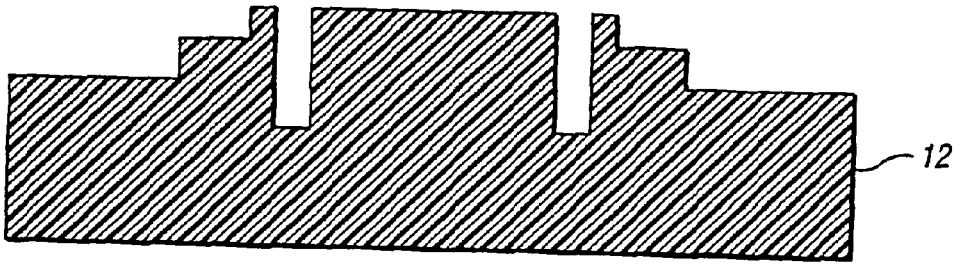

Referring to the drawings, one method of making a spray formed article 16, such as a spray formed tool, according to the present invention, is shown. The method comprises creating, making or providing a master model 12 of a desired tool as illustrated in FIGS. 1*a* and 1*b*. The master model 12 can be made by any suitable process. In one such process, the master model 12 is a CAD/CAM design made in accordance with suitable "rapid prototyping techniques". Such techniques are disclosed in U.S. Pat. No. 5,658,506 to White et al., the disclosure of which is hereby incorporated by reference. Other suitable "rapid prototyping techniques", such as SLS, SLA, LOM, can also be used. In another suitable process for making the master model 12, the master model 12 is milled or otherwise formed out of wood, renboard, metal, laminate materials, or other suitable materials.

Figure 1C:
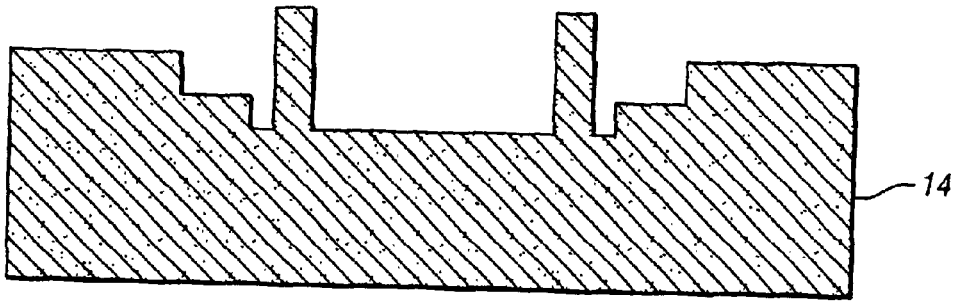

The method comprises the step of making a sand pattern 14 as the inverse of the master model 12, as illustrated in FIG. 1*c*.

In one preferred embodiment, the sand pattern 14 is formed from a sand molding composition. A suitable sand molding composition is prepared and then poured over the master model 12, which is preferably placed in a container (not shown) with the master model 12 facing up. Preferably, a release agent such as silicone or wax is applied to the master model 12 before the sand molding composition is poured over it. Preferably, the sand composition is packed down and/or subjected to vibration to densify the composition to form a sand pattern 14 with little or no voids over time. The molding composition is then heated to activate the binder to cure the sand pattern 14. Alternatively, the molding compound could be provided with a catalyst that activates the binder to cure the sand pattern 14.

In one embodiment, a particularly preferred sand molding composition comprises refractory material and a binder. In this embodiment, the refractory material is preferably present in the sand molding composition in an amount of about 75 to 98 weight percent, based on the total weight of sand molding composition, more preferably in an amount of about 85 to 95 weight percent, and most preferably in an amount of about 88 to 92 weight percent. The refractory material preferably comprises at least about 15 weight percent alumina, based on the total weight of the refractory material, more preferably about 15 weight percent to about 85 weight percent, even more preferably about 20 weight percent to about 60 weight percent, and most preferably about 25 weight percent to about 40 weight percent. If the refractory material comprises less than 100 weight percent alumina, the other suitable refractory materials include, but are not limited to, silica sand, zircon, chromite, clay, magnesite, olivine, chamotte, chromite, silicon carbide, dolomite, aluminum silicate, carbon, mullite, forsterite, chrome ore-magnesite, and mixtures thereof. The refractory material preferably has an average particle size of about 25 to 400 microns, more preferably about 50 to 250 microns, and most preferably about 65 to 150 microns. Preferably, the alumina has a lower (i.e., smaller) average particle size than the other refractory material present.

In one embodiment, the refractory material preferably has an average particle size of less than about 150 microns and comprises a mixture of about 85 to 15 weight percent silica sand and about 15 to 85 weight percent alumina, based on the total weight of the refractory material, and more preferably about 80 to 40 weight percent silica sand and about 20 to 60 weight percent alumina, and most preferably about 75 to 60 weight percent silica sand and about 25 to 40 weight percent alumina. In one preferred embodiment, the alumina comprises T-64 (~100 mesh) alumina from Alcoa having an average particle size of about 65 to 85 microns and the silica sand comprises #810 Wedron silica sand having an average particle size of about 95 to 150 microns from Wedron Silica of Wedron, Ill.

In one embodiment, the binder is preferably present in the sand molding composition in an amount of about 2 to about 25 weight percent, based on the total weight of the sand molding composition, more preferably in an amount of about 5 to about 20 weight percent, and most preferably in an amount of about 8 to about 12 weight percent. While any suitable organic and/or inorganic binder may be used, it is preferred that the binder be an inorganic, water-soluble binder. In one embodiment, the binder comprises an alkali silicate binder, and even more preferably, a sodium silicate binder. In one preferred embodiment, the binder comprises the sodium silicate binder Chem Bond 12-31 available from HA International of Detroit, Mich.

In one embodiment, a catalyst is preferably present in the sand molding compound in an amount of about 10 weight percent of the binder, based on the total weight of the binder, more preferably in an amount of about 0.2 to about 2.5 weight percent, based on the total weight of the sand molding compound, even more preferably in an amount of about 0.5 to about 2.0 weight percent of the total weight of the sand molding compound, and most preferably in an amount of about 0.8 to about 1.2 weight percent of the total weight of sand molding compound.

The catalyst preferably comprises any suitable catalyst, such as an organic ester, an organic carbonate, an organic acid, inorganic oxides, and mixtures thereof. In one preferred embodiment, the catalyst comprises the organic ester catalyst Chem Bond 240 available from HA International.

When a catalyst is used, the sand molding composition is preferably prepared by mixing the catalyst with the refractory material and then mixing in the binder. The sand molding composition is then poured over the model 12, which is placed in a container, and then cured, as described above, to form a sand pattern 14. The sand pattern 14 is then removed from the model 12 by any conventional means.

As illustrated in FIGS. 1*d* and 1*e*, the method comprises the step of spraying metallic material against the sand pattern 14 to form a spray formed rapid tool 16 as the desired tool. In one preferred embodiment, the sand pattern 14 is preheated to a temperature of about 200–300° C. prior to the spraying step. The spraying step may be performed using any suitable metal spraying process, such as the processes that are described in U.S. Pat. Nos. 6,279,431, 5,967,218, and 5,658,506.

In one embodiment, one or more spray guns 22, shown schematically in the FIG. 1*d*, is preferably utilized to spray the particles 20 onto the sand pattern. While any suitable spray forming gun(s) could be employed, one suitable example of a spray forming gun is an oxy-acetylene flame thermal spray gun in which a wire or powder metal is fed thereinto. Cold spraying guns could be used in place of thermal spray guns to spray metallic particles. Also, a single or two wire arc, thermal spraying gun(s) could be used.

Such step is preferably carried out by the wire arc process. Another method to carry out the step of spraying is the osprey thermal spraying process wherein a semi-solid slurry of hardenable metal material is sprayed from an induction heated nozzle supply and is impelled against the sand pattern 14 with a high velocity due to the high pressure gases that atomize the molten fluid. Metal droplets are formed from a melt that is atomized by gas (not from wire or powder). The pattern 14, being formed from a sand molding compound containing at least 15 weight percent alumina, results in good adhesion of the metal to the pattern. Preferably, continuous spraying is carried out to build up a layer (i.e., deposit) that exceeds at least 1/16 inch, and more preferably 1/8 inch, in thickness, at its thinnest section. As the spray is applied and built up, the spray formed article 16 is formed as illustrated in FIGS. 1*d,* 1*e,* and 1*f.*

Examples of metals usable for this purpose include, but are not limited to, metals such as zinc, aluminum, and high temperature high strength carbon steel, and alloys. These include certain tool steels such as A2 and plain carbon steel (with 0.8% carbon by weight) as well as maraging steels.

The density of the sprayed metal in accordance with this invention, will vary depending on the spray process used, but is generally between about 95–99.5%. If the spray formed article 16 is made by the osprey process, the density will typically be about 99.5% and if it is made by an arc spraying process such as twin arc, the density will typically be about 95%. The osprey process provides virtually no porosity in the as deposited metal because of the use of a semi-solid slurry that constantly feeds the solidifying metal material. The spraying process will result in little or no shrinkage because of such continuous feeding of deposited material. The osprey spraying process results in a finer microstructure.

Once the spray formed article 16 is formed, the sand pattern 14 can be removed from the spray formed article 16 by any suitable method. Since the sand pattern 14 is from a sand molding compound containing a water-soluble binder, the sand pattern 14 is preferably removed by exposing the pattern 14 to water, preferably steam, to dissolve the binder, thus degrading the pattern. This removal method aids in retaining delicate features and sharp corners in the spray formed article 16.

Other suitable articles formed by the above described method includes any metallic articles capable of being formed by spray forming methods. Some non-limiting examples of such articles and their uses includes, but are not limited to stamping dies, injection molding tools, vacuum forming tools, thermoforming tools and die casting tools.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method of making a spray formed article, the method comprising the steps of:

providing a sand pattern that has an inverse of at least a portion of the surface of a desired spray formed article, the spray forming pattern being the cured product of a sand molding composition comprising refractory material and binder, the refractory material comprising at least about 15 weight percent alumina, based on the total weight of the refractory material; and spraying metallic material against the sand pattern to form a desired spray formed article on the sand pattern.

2. A method as set forth in claim 1 wherein the step of providing a sand pattern comprises making a model of the desired spray formed article and constructing the sand pattern as the inverse of the model.

3. A method as set forth in claim 2 wherein the step of constructing the sand pattern comprises depositing a sand molding composition over the model and curing the sand molding composition to form the sand pattern.

4. A method as set forth in claim 3 wherein the refractory material is present in the sand molding composition in an amount of about 75 to 98 weight percent.

5. A method as set forth in claim 4 wherein the alumina is present in the sand molding composition in an amount of about 1 to 85 weight percent, based on the total weight of the refractory material.

6. A method as set forth in claim 5 wherein the alumina is present in the sand molding composition in an amount of about 25 to 40 weight percent, based on the total weight of the refractory material.

7. A method as set forth in claim 5 wherein the binder comprises an inorganic binder which is present in the sand molding composition in an amount of about 2 to 25 weight percent, based on the total weight of the sand molding composition.

8. A method as set forth in claim 5 wherein the binder comprises an inorganic, water-soluble binder.

9. A method as set forth in claim 8 wherein the binder comprises sodium silicate.

10. A method as set forth in claim 3 wherein the sand molding composition further comprises a catalyst which is present in the sand molding composition in an amount of about 0.2 to 2.5 weight percent, based on the total weight of the sand molding composition.

11. A method as set forth in claim 10 wherein the curing of the sand molding composition takes place without the addition of any heat.

12. A method as set forth in claim 3 wherein the curing of the sand molding composition requires heat.

13. A method as set forth in claim 5 wherein the refractory material has an average particle size of about 25–400 microns.

14. A method as set forth in claim 8 further comprising separating the sand pattern from the desired article, wherein the step of separating comprises exposing the sand pattern to water.

15. A method as set forth in claim 1 wherein the refractory material comprises about 85 to 15 weight percent silica sand and about 15 to 85 weight percent alumina.

16. A method as set forth in claim 15 wherein the sand molding composition further comprises a catalyst which is present in the sand molding composition in an amount of about 0.2 to 2.5 weight percent, based on the total weight of the sand molding composition.

17. A method as set forth in claim 1 wherein the spray formed article comprises a tool.

18. A method of making a spray formed article, the method comprising the steps of:

providing a sand pattern that has an inverse of at least a portion of the surface of a desired spray formed article, the spray forming pattern being the cured product of a sand molding composition comprising refractory material present in the sand molding composition in an amount of about 75 to 98 weight percent, based on the total weight of the sand molding composition, an inorganic, water-soluble binder present in the sand molding composition in an amount of about 2 to 25 weight percent, based on the total weight of the sand molding composition, and catalyst present in the sand molding composition in an amount of about 0.2 to 2.5 weight percent, based on the total weight of the sand molding composition, wherein the refractory material has an average particle size of about 25–400 microns and comprises silica sand and at least about 15 weight percent alumina, based on the total weight of the refractory material, wherein the alumina has a smaller average particle size than the silica sand;

spraying metallic material against the sand pattern to form a desired spray formed article on the sand pattern; and separating the sand pattern from the desired article by exposing the sand pattern to water.

* * * * *